US006092373A

United States Patent [19]

Mundinger

[11] Patent Number: 6,092,373

[45] Date of Patent: Jul. 25, 2000

[54] CRYOPUMP

[75] Inventor: Hans-Jurgen Mundinger, Export, Pa.

[73] Assignee: Leybold Vakuum GmbH, Cologne, Germany

[21] Appl. No.: 09/242,006

[22] PCT Filed: Mar. 8, 1997

[86] PCT No.: PCT/EP97/01183

§ 371 Date: Feb. 5, 1999

§ 102(e) Date: Feb. 5, 1999

[87] PCT Pub. No.: WO98/06943

PCT Pub. Date: Feb. 19, 1998

[30] Foreign Application Priority Data

Aug. 16, 1996 [DE] Germany ..... 196 32 123

[51] Int. Cl.[7] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,423,947 | 1/1969 | Moriya . | |
| 3,585,807 | 6/1971 | Hengevoss et al. . | |
| 3,785,162 | 1/1974 | Long et al. . | |
| 4,285,710 | 8/1981 | Welch . | |
| 4,614,093 | 9/1986 | Bächler et al. . | |
| 4,667,477 | 5/1987 | Matsuda et al. | 62/55.5 |
| 4,736,591 | 4/1988 | Amos et al. . | |
| 4,745,761 | 5/1988 | Bazaj et al. | 62/55.5 |
| 4,757,689 | 7/1988 | Bächler et al. . | |
| 4,815,303 | 3/1989 | Duza . | |
| 4,827,736 | 5/1989 | Miura et al. | 62/55.5 |
| 5,111,667 | 5/1992 | Häfner et al. . | |
| 5,343,709 | 9/1994 | Kohler . | |
| 5,465,584 | 11/1995 | Mattern-Klosson et al. . | |
| 5,537,833 | 7/1996 | Matte et al. . | |
| 5,542,257 | 8/1996 | Mattern-Klosson et al. . | |

FOREIGN PATENT DOCUMENTS

| | | | |
|---|---|---|---|
| 29 36 931 | 3/1980 | Germany . | |
| 35 12614 | 10/1986 | Germany . | |
| 36 35 941 | 6/1987 | Germany . | |
| 0 250 613 | 1/1988 | Germany . | |
| 40 06 755 | 9/1991 | Germany . | |
| 91 11 236 | 7/1992 | Germany . | |
| 42 01 755 | 7/1993 | Germany . | |
| 43 24 311 | 1/1994 | Germany . | |
| 43 36 035 | 4/1995 | Germany . | |
| 6-58257 | 3/1994 | Japan | 62/55.5 |
| 1128123 | 9/1968 | United Kingdom . | |
| 2 182 101 | 5/1987 | United Kingdom . | |
| WO95/11381 | 4/1995 | WIPO . | |

OTHER PUBLICATIONS

Patent Abstracts of Japan vol. 008, No. 240 (M–336), Nov. 6, 1984 & JP 59 119076 A (Toshiba KK), Jul. 10, 1984.

*Primary Examiner*—Ronald Capossela
*Attorney, Agent, or Firm*—Wall Marjama Bilinski & Burr

[57] ABSTRACT

The invention relates to a cryopump having pump surfaces which are held at different temperatures during operation and are disposed in a housing with a flange for connecting the housing to a vacuum chamber. Additional pump surfaces are provided for the accumulation of easily condensable gases and improve the suction performance of the cryopump. These additional pump surfaces are disposed in the vacuum chamber and are connected to a first stage of a two stage refrigeration head via a cold bridge.

20 Claims, 3 Drawing Sheets

CRYOPUMP

BACKGROUND OF THE INVENTION

This invention concerns a cryopump comprising pump surfaces held at different temperatures during operation and situated in a housing with a flange for connecting the pump to a vacuum chamber.

Cryopumps for the production of a high and ultrahigh vacuum are generally operated using a two-stage refrigerator comprising a two-stage refrigeration head. Cryopumps have three pump surface areas designed to adsorb various types of gas. The first surface area is thermally well linked to the first stage of the refrigeration head and attains a temperature of about 80 K, depending on the type and power rating of the refrigerator. Commonly, a thermal radiation shield and a baffle are assigned to these surface areas. These components protect the pump surfaces at lower temperatures against being exposed to entering thermal radiation. Moreover, they form the pump surfaces of the first stage, preferably serving the purpose of adsorbing relatively easily condensable gases, like hydrogen and carbon dioxide, by way of cryo-condensation.

The second pump surface area is thermally well linked to the second stage of the refrigeration head. During operation of the pump this stage attains a temperature of about 20 K and less. The second surface area is preferably employed to remove gases which only condense at lower temperatures, like nitrogen, argon or alike by way of cryocondensation, as well as trapping lighter gases like $H_2$ or He in a majority of the aforementioned condensable gases. The third pump surface area also attains the same temperature as the second stages of the refrigeration head (in the case of a refrigeration head having three stages correspondingly lower) said pump surface being covered by an adsorbing material. Chiefly the process of cryosorption of lighter gases like hydrogen, helium and alike takes place on these pump surfaces.

When employing cryopumps in the areas of coating technology, sputter processes or ion implantation, the suction performance for water vapour which is restricted by the size of the high vacuum flange and the related pump surfaces will no longer be sufficient. In such cases, the additionally required pumping performance for water vapour is attained by further pump surfaces which are installed in the process chamber. These pump surfaces are cooled with liquid nitrogen (MeiBner trap), with Freon, with Freon substitute machines or single-stage refrigerators like those operating according to the Gifford-McMahon principle. Cooling the additionally required pump surfaces with liquid nitrogen is relatively costly; handling of the liquid nitrogen is involved. The Freon coolers are large and expensive; even the Freon substitutes may not be employed without reservations as to the environment. Finally, also additional refrigerators are involved and expensive.

SUMMARY OF THE INVENTION

It is the task of the present invention to equip a cryopump of the aforementioned kind with additional pump surfaces for water vapour, without having to suffer the disadvantages described.

This task is solved through the present invention by equipping the cryopump with further pump surfaces for adsorbing water vapour, which are situated outside of their housing and which are linked by means of a cold bridge to the first stage of the refrigeration head. Through these measures it becomes possible to employ only one refrigerating machine—specifically the refrigerator of the already present cryopump—for the pump surfaces of the cryopump and for the additionally installed pumping capacity for water vapour. The pump surfaces outside the housing of the cryopump for pumping water vapour are preferably arranged directly within the process chamber and may be adapted to its geometrical arrangement. Separate refrigerating machines or cold sources are no longer required.

In order to be able to operate the additional pump surfaces for water vapour with an optimum effect, it is expedient to equip these with a sensor and a heater. Thus it is possible to adjust their temperature to optimum values.

The refrigerator of the cryopump must be designed in such a manner that the refrigerating power of the first stage of the refrigeration head will suffice to adequately cool both the thermal radiation shield and the baffle of the cryopump and also the additional pump surfaces for water vapour. Refrigerators of this kind are known. These are no larger than the dimensions of the refrigeration head and also the compressor. Due to the increased refrigerating power of the first stage, it is advantageous for optimum operation of the cryopump, that the refrigerating power branched off for the additional pump surfaces be switchable on and off.

BRIEF DESCRIPTION OF THE DRAWINGS

Further advantages and details of the present invention shall be explained by referring to the design examples presented in drawing FIGS. 1 to 6. Depicted in drawing

DETAILED DESCRIPTION OF THE INVENTION

Figure 1:
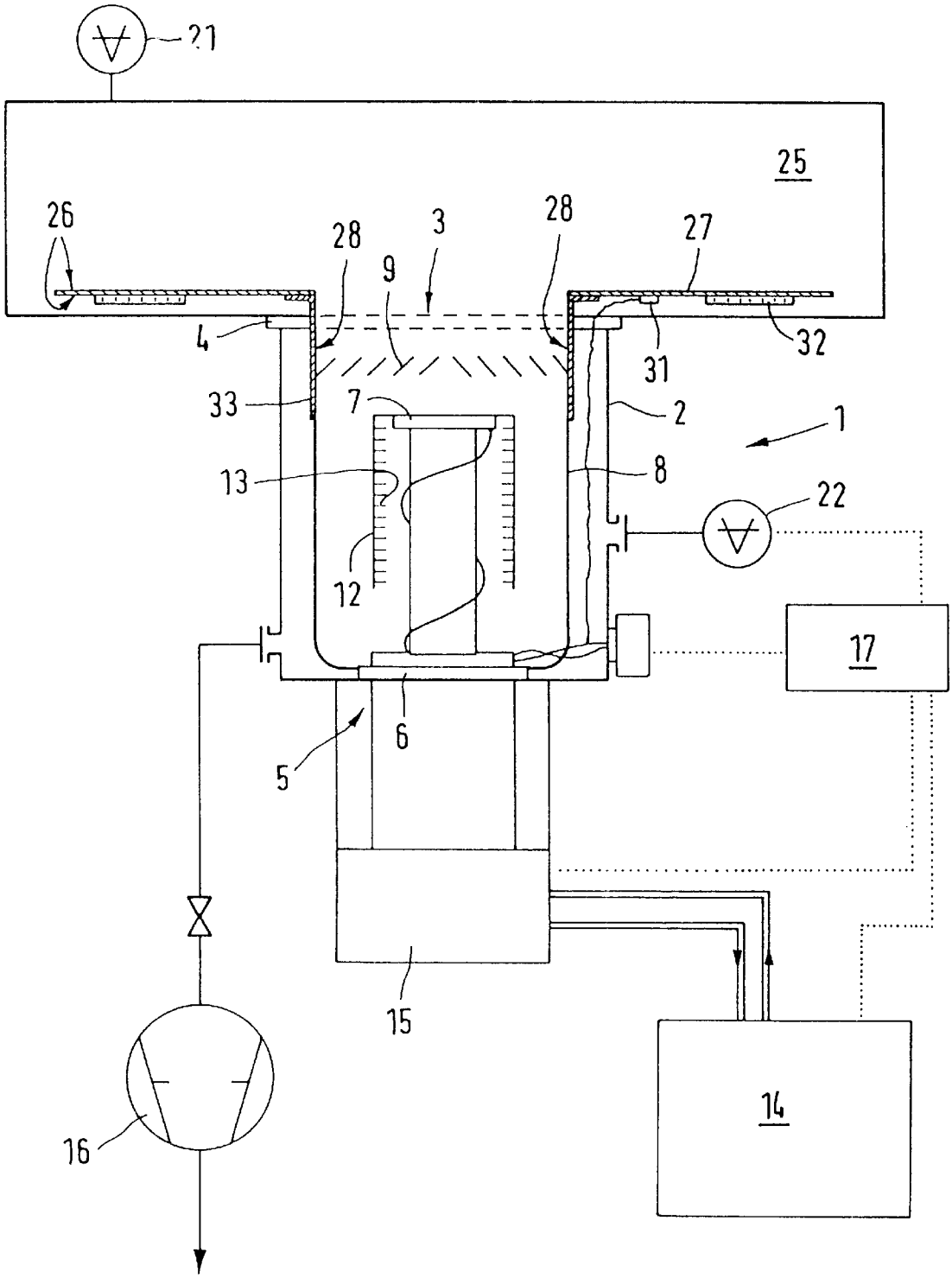
FIG. 1 is a cryopump with additionally installed pumping capacity for water vapour connected to a process chamber, drawing

Components of the cryopumps 1 depicted in the drawing figures are the housing 2 with flange 4 surrounding the inlet opening 3, as well as the two-stage refrigeration head 5 with its stages 6 and 7 accommodated in housing 2. Linked to the first stage 6 of the refrigerator 5 is the thermal radiation shield 8 which in turn carries the baffle 9 situated within the inlet area. The second stage 7 of the refrigeration head 5 is situated within the thermal radiation shield 8 and carries panel sections forming the second pump surface area 12 and the third pump surface area 13.

The two-stage refrigeration head 5 is part of a Gifford-McMahon refrigerator to which the compressor 14 for the working gas (helium) and the drive motor 15 for a valve system which is not shown, belong. Designated as 16 is a backing pump connected to housing 2. Used for controlling the refrigerator is a control unit 17 which is linked to pressure gauges 21, 22 as well as pressure and temperature sensors in housing 2— not detailed—at the two stages 6, 7 of the refrigeration head and/or the pumping surfaces 12, 13. These are employed to control the operation and the regeneration of the cryopump 1.

The cryopump 1 is connected to a vacuum chamber 25, the pressure of which is monitored by gauge 21, and in which a process giving rise to increased quantities of water vapour is performed. In order to dispense with additional refrigerating machines with condensation surfaces for water vapour, the cryopump 1 itself is equipped with additional pump surfaces 26 situated in the vicinity of the inlet 3 for the vacuum chamber 25. Preferably the inlet 3 is surrounded by an annular panel 27 made of thermally well conducting material (copper, for example) forming the additional pumping surfaces 4, said panel being linked by means of one or several cold bridges 28 to the thermal radiation shield 8 or directly to the first stage 6 of the refrigeration head 5. For the purpose of setting up an optimum operating temperature, the pump surfaces 26 are equipped with a temperature sensor 31 and a heater 32, which are linked to the control unit 17 by connections which are only partly shown.

In the design example according to drawing FIG. 1, the cold bridges 28 consist of rods or metal strips 33 which are reversibly connected to, and in close thermal contact with the thermal radiation shield 8 through which the inlet opening 3 passes through and where said rods or strips carry the pump surfaces 26 or the annular panel 27.

Figure 2:
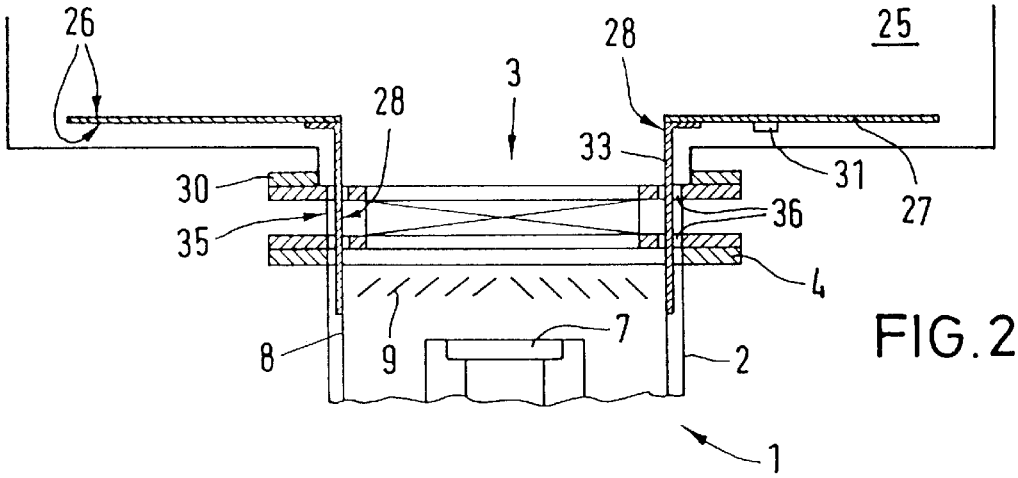
FIG. 2 is a cryopump according to drawing FIG. 1 having a high vacuum valve and drawing

In the design example according to drawing FIG. 2, a separate high vacuum valve 35 is situated between the cryopump 1 with its flange 4 and the vacuum chamber 25 with its flange 30. In order to be able to lead the cold bridges 28 from the inside of cryopump 1 into the vacuum chamber 25 the flanges of the valve 35 are equipped exterior the opening of valve 35 with thermal feedthroughs 36. The inside diameter of the flange 4 of cryopump 1 and flange 30 of the vacuum chamber 25 is preferably selected as being so wide that the cold bridge (u) 28 in the vacuum chamber 25 or in the housing 2 of the cryopump 1 is situated at the level of said flanges. If the valve 35 has been integrated into the cryopump 1 then a solution of this kind is also expedient.

Figure 3:
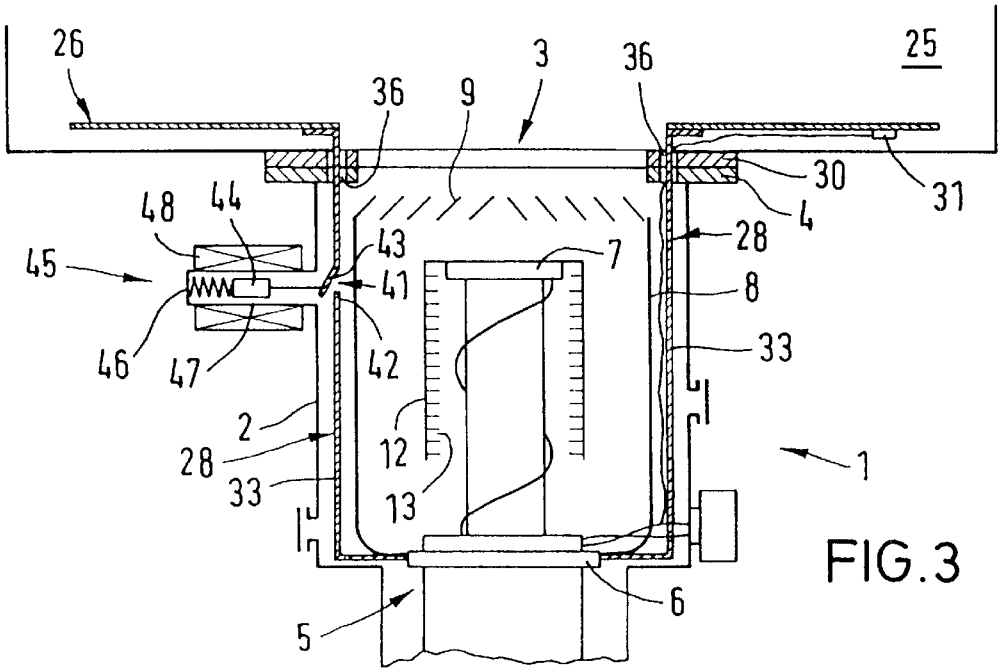
FIGS. 3 to 6 are cryopumps with different cold bridges for additional pump surfaces when pumping water vapour.

In the design example according to drawing FIG. 3, the rod or strip like cold bridges 28 or 33 are thermally directly linked to the first stage 6 of the refrigeration head 5. Both the flange 4 of the cryopump 1 and also the flange 30 of the vacuum chamber are equipped with thermal feedthroughs 36. The term "thermal feedthrough" indicates such feedthroughs which thermally isolate the thermal bridge 28 against the flange 4 or 30.

As already mentioned, it is expedient that the refrigerating power applied to the additional pump surfaces 26 be switchable. A mechanical thermal switch 41 a s depicted, for example, in drawing FIG. 3, left, may be employed for this purpose. The cold bridge 28 is interrupted at the location of the thermal switch 41 and has two overlapping sections 42 and 43. At least section 43 is designed to be movable (can be bent, flexed, swivelled or similar) and is linked to the armature 44 of a solenoid drive 45. The armature 44 is subjected to the effect of a spring 46. Armature 44 and spring 46 are situated in a tube-shaped housing stud 47. The coil 48 surrounds this housing stud 47. By actuating the solenoid drive 45, the supply of cold to the additional pump surfaces 26 may be switched on or off. Depending on whether the spring 46 is a tension or compression spring, switch 41 will be of the normally open or normally closed type. Instead of the solenoid drive, a pneumatic drive may also be provided.

Figure 4:
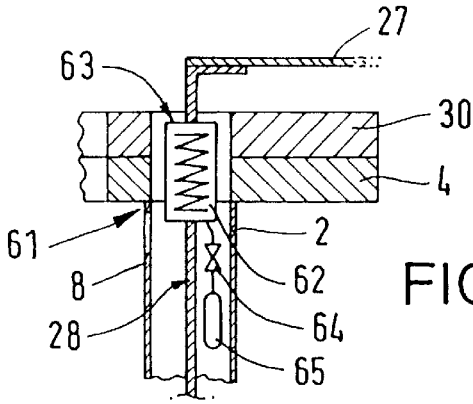

Presented in drawing FIG. 4 is a further implementation for a thermal switch which is designed as a gas actuated thermal switch 61. It comprises hollow space 62 with a cylindrical housing 63, said hollow space being integrated in the cold bridge 28. The face sides of the housing 63 consist of thermally well conducting material whereas its cylindrical section consists of a material conducting heat only poorly. The hollow space 62 is linked by means of a valve 64 to a gas reservoir vessel 65. If the hollow space 62 is filled with gas, switch 61 is closed. In order to break the thermal contact, the contact gas is admitted into the reservoir vessel 65 after opening of valve 64. This may be performed with the aid of an adsorbent accommodated within the reservoir vessel 65, this adsorbent being cooled to the temperature of the first stage 6 of the refrigeration head 5. With the aid of a heater which is not shown, the gas may then again be driven out of the reservoir vessel 65.

Figure 5:
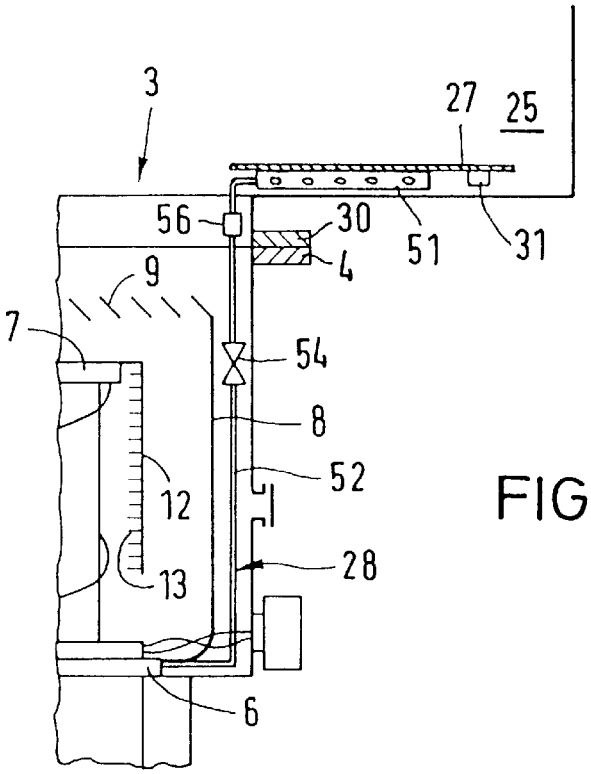
Figure 6:
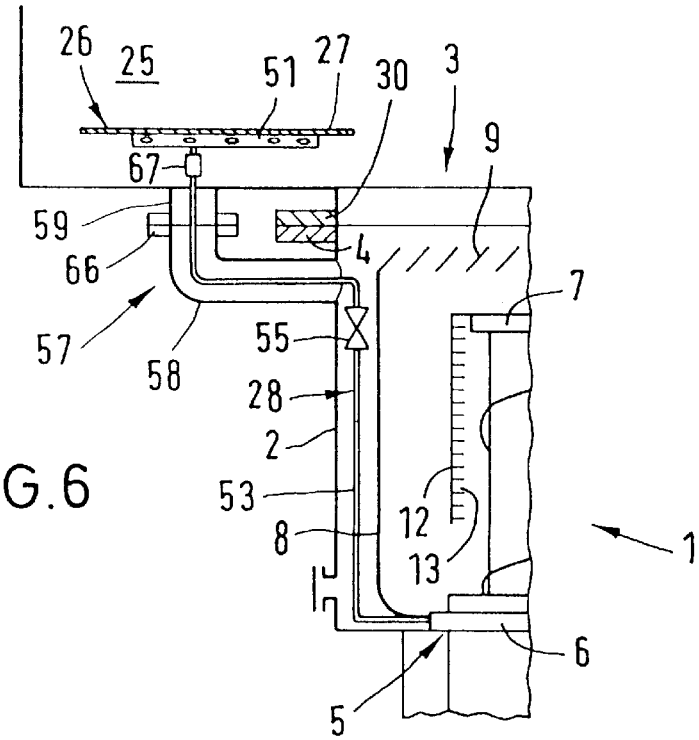

In the design examples according to drawing FIGS. 5 and 6, the additional pump surfaces 26 are equipped with a heat exchanger 51, through which cold gas flows during operation. This gas may be cold working gas (helium) from the first stage 6 of refrigeration head 5. The cold bridges 28 are therefore designed as tubes 52, 53 which link the heat exchanger 51 to the first stage 6 of the refrigeration head 5. In order to be able to switch and/or control the supply of cold, the tubes 52, 53 are equipped with valves 54, 55. The refrigerant return lines are not shown in detail.

In the design example according to drawing FIG. 5, the tube 52 is lead through flanges 4, 30. A schematically represented screwed joint 56 allows to separate the pump surfaces 26 situated in the vacuum chamber 25 from the remaining components of the cryopump 1.

The implementation according to drawing FIG. 6 is equipped with a bypass 57 which bypasses the flanges 4, 30. This solution is expedient if—as is the case for the cryopump 1 according to drawing FIG. 2—a valve 35 is present. The bypass 57 consists of a connecting stud 58 at the housing 2 of the cryopump 1 and a connecting stud 59 at vacuum chamber 25. These are releasably connected to each other with the aid of a flange connection 66[1]. Tube 53 with its screwed joint 67 is lead through the bypass 57. The inside of the bypass 57 is under a vacuum so that the first stage 6 of the refrigeration head 5 may be linked without the risk of heat losses to the heat exchanger 51.

[1] Translator's note: The German text states "61" here whereas "66" would be more in line with the remaining text and the drawing figures. Therefore "66" has been assumed for the translation.

Alternatively to the solution according to drawing FIG. 6, foamed material insulation may be provided instead of the bypass 57 so that the valve—insulated by the foamed material—is freely accessible. In the case of this solution only two thin feedthroughs are needed for the helium line 52 or 53.

What is claimed is:

1. A cryopump including a housing with a first flange for connecting the housing to a vacuum chamber, said cryopump comprising:

a plurality of pump surfaces disposed within said housing that are held at different temperatures;

at least one additional pump surface disposed outside said housing;

a refrigerator having a refrigeration head disposed within said housing, said refrigeration head having at least two stages including a first stage; and at least one cold bridge for connecting said at least one additional pump surface to said first stage.

2. The cryopump of claim 1, wherein said at least one additional pump surface is disposed within said vacuum chamber.

3. The cryopump of claim 2, wherein said at least one additional pump surface is formed by a panel surrounding an inlet opening of said cyropump.

4. The cryopump of claim 1, wherein said at least one additional pump surface includes a temperature sensor and a heater.

5. The cryopump of claim 1, wherein said vacuum chamber includes a second flange adjacent said first flange on said housing and wherein said at least one cold bridge is disposed inside of said first and second flanges.

6. The cryopump of claim 5, further including a bypass means which connects said cryopump to said vacuum chamber and bypasses said first and second flanges and said at least one cold bridge being disposed within said bypass.

7. The cryopump of claim 6, wherein said bypass means includes first and second sections, said sections being connected by a third flange.

8. The cryopump of claim 1, wherein said vacuum chamber includes a second flange, said first and second flanges having adjacent outer rims, at least one thermal feedthrough passing through the rims, and said at least one cold bridge being disposed in said at least one thermal feedthrough.

9. The cryopump of claim 8, further including a high vacuum valve disposed between said first and second flanges.

10. The cryopump of claim 1, wherein said at least one cold bridge comprises rods or strips of thermal conducting material.

11. The cryopump of claim 10, wherein said at least one cold bridge includes a mechanically actuated thermal switch.

12. The cryopump of claim 11, wherein said at least one cold bridge includes two overlapping contact sections, wherein at least one of the two sections is movable out of contact with the other section, whereby said at least one additional pump surface can be thermally connected to said first stage.

13. The cryopump of claim 12, wherein said at least one movable section is connected to a drive selected from the group consisting essentially of a solenoid drive or a pneumatic drive.

14. The cryopump of claim 12, wherein said at least one movable section is connected to a solenoid drive, said solenoid drive comprising an armature and a coil, said armature being disposed within a cylindrical member.

15. The cryopump of claim 10, wherein said at least one cold bridge includes a gas actuated thermal switch.

16. The cryopump of claim 1, wherein said at least one additional pump surface includes a heat exchanger and said at least one cold bridge includes a tube line for a refrigerant.

17. The cryopump of claim 16, wherein said tube line includes a valve.

18. The cryopump of claim 16, wherein said vacuum chamber includes a second flange and wherein said tube line has a section that is disposed outside of said first and second flanges.

19. The cryopump of claim 18, including a bypass means for thermally insulating said tube section.

20. The cryopump of claim 18, including a foamed material for thermally insulating said tube section.

* * * * *